US008776890B2

(12) United States Patent
Basmajian et al.

(10) Patent No.: US 8,776,890 B2
(45) **Date of Patent: *Jul. 15, 2014**

(54) SYSTEMS AND TECHNIQUES TO ACTUATE ISOLATION VALVES

(75) Inventors: Arin Basmajian, Houston, TX (US); Brad Swenson, Houston, TX (US); John R. Whitsitt, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/612,640

(22) Filed: Sep. 12, 2012

(65) Prior Publication Data

US 2013/0240212 A1 Sep. 19, 2013

Related U.S. Application Data

(63) Continuation of application No. 13/248,107, filed on Sep. 29, 2011, now abandoned, which is a continuation of application No. 12/055,456, filed on Mar. 26, 2008, now Pat. No. 8,056,643.

(51) Int. Cl.

| | |
|---|---|
| ***E21B 34/14*** | (2006.01) |
| ***E21B 34/10*** | (2006.01) |
| ***E21B 23/00*** | (2006.01) |
| ***G05D 11/00*** | (2006.01) |
| ***F16K 31/12*** | (2006.01) |
| ***F16K 31/36*** | (2006.01) |
| ***F16D 31/02*** | (2006.01) |
| ***F01L 21/00*** | (2006.01) |

(52) U.S. Cl.

USPC ..... 166/334.1; 166/240; 166/320; 166/386; 137/87.01; 137/488; 60/371; 91/218

(58) Field of Classification Search

USPC ..... 166/255.2, 386, 320, 332.1, 334.1, 240; 137/87.01, 488; 60/371; 91/218

See application file for complete search history.

(56) References Cited

U.S. PATENT DOCUMENTS

| | | | | |
|---|---|---|---|---|
| 4,188,968 | A * | 2/1980 | Trobaugh et al. | 137/236.1 |
| 4,570,724 | A * | 2/1986 | Robison | 175/113 |
| 5,101,907 | A * | 4/1992 | Schultz et al. | 166/386 |
| 5,810,087 | A | 9/1998 | Patel | |
| 5,950,733 | A | 9/1999 | Patel | |
| 6,055,213 | A | 4/2000 | Rubbo et al. | |
| 6,167,968 | B1 * | 1/2001 | Allarie et al. | 166/298 |
| 6,230,807 | B1 * | 5/2001 | Patel | 166/321 |
| 6,241,015 | B1 * | 6/2001 | Pringle et al. | 166/66.4 |
| 6,247,536 | B1 * | 6/2001 | Leismer et al. | 166/305.1 |

(Continued)

FOREIGN PATENT DOCUMENTS

| | | | |
|---|---|---|---|
| GB | 2312909 | A | 11/1997 |
| WO | 2009033042 | A1 | 3/2009 |

*Primary Examiner* — Jennifer H Gay

(74) *Attorney, Agent, or Firm* — David J. Groesbeck; Brandon S. Clark

(57) ABSTRACT

A tool that is usable in a well and may include an operator, a switch, a resilient device and an indexer. The switch may be configured to selectively communicate a first force to the operator, thereby actuating the tool. The resilient device may exert a second force. The indexer may cycle through a sequence of positions in response to alternating between the second force and a third force. The sequence includes a predetermined position configured to actuate the switch, thereby communicating the first force to the operator to actuate the tool.

9 Claims, 4 Drawing Sheets

(56) References Cited

U.S. PATENT DOCUMENTS

| | | | | |
|---|---|---|---|---|
| 6,405,804 | B1 | 6/2002 | Ohmer et al. | |
| 6,488,090 | B1 | 12/2002 | Ohmer | |
| 6,491,102 | B2 * | 12/2002 | Leismer et al. | 166/316 |
| 6,494,269 | B2 | 12/2002 | French et al. | |
| 6,523,613 | B2 * | 2/2003 | Rayssiguier et al. | 166/320 |
| 6,550,541 | B2 * | 4/2003 | Patel | 166/386 |
| 6,691,785 | B2 * | 2/2004 | Patel | 166/375 |
| 6,722,439 | B2 * | 4/2004 | Garay et al. | 166/373 |
| 6,776,240 | B2 * | 8/2004 | Kenison et al. | 166/330 |
| 6,782,952 | B2 * | 8/2004 | Garay et al. | 166/374 |
| 6,973,974 | B2 * | 12/2005 | McLoughlin et al. | 166/386 |
| 7,270,191 | B2 | 9/2007 | Drummond et al. | |
| 7,322,416 | B2 | 1/2008 | Burris, II et al. | |
| 7,464,761 | B2 * | 12/2008 | Hosatte et al. | 166/313 |
| 7,690,432 | B2 * | 4/2010 | Noske et al. | 166/319 |
| 7,748,461 | B2 * | 7/2010 | Loretz et al. | 166/319 |
| 8,056,643 | B2 * | 11/2011 | Basmajian et al. | 166/386 |
| 8,443,901 | B2 * | 5/2013 | Moen | 166/373 |
| 2002/0046843 | A1 * | 4/2002 | Rayssiguier et al. | 166/373 |
| 2002/0046845 | A1 * | 4/2002 | Rayssiguier et al. | 166/375 |
| 2002/0066574 | A1 * | 6/2002 | Leismer et al. | 166/375 |
| 2002/0112862 | A1 * | 8/2002 | Patel | 166/386 |
| 2003/0183392 | A1 * | 10/2003 | Garay et al. | 166/320 |
| 2004/0069491 | A1 * | 4/2004 | Garay et al. | 166/320 |
| 2007/0119594 | A1 * | 5/2007 | Turner et al. | 166/319 |
| 2007/0187107 | A1 * | 8/2007 | Pringle | 166/319 |
| 2009/0065218 | A1 * | 3/2009 | Loretz et al. | 166/375 |
| 2009/0065257 | A1 * | 3/2009 | Noske et al. | 175/57 |
| 2009/0242199 | A1 * | 10/2009 | Basmajian et al. | 166/255.2 |
| 2010/0038093 | A1 * | 2/2010 | Patel | 166/375 |
| 2010/0206579 | A1 * | 8/2010 | Guven et al. | 166/373 |
| 2011/0083859 | A1 * | 4/2011 | Scranton et al. | 166/374 |
| 2012/0018170 | A1 * | 1/2012 | Basmajian et al. | 166/374 |

* cited by examiner

SYSTEMS AND TECHNIQUES TO ACTUATE ISOLATION VALVES

CROSS REFERENCE TO RELATED APPLICATIONS

This application is a continuation to and claims the benefit of U.S. Non-Provisional application Ser. No. 13/248,107 filed Sep. 29, 2011, entitled "SYSTEMS AND TECHNIQUES TO ACTUATE ISOLATION VALVES", to Basmajian et al., now abandoned, which, in turn, and is a continuation to and claims the benefit of U.S. Pat. No. 8,056,643, filed Mar. 26, 2008 as Ser. No. 12/055,456 and issued Nov. 15, 2011, entitled "SYSTEMS AND TECHNIQUES TO ACTUATE ISOLATION VALVES", to Basmajian et al., the disclosures of which are incorporated by reference herein in their entirety.

BACKGROUND

The invention generally relates to systems and techniques to actuate isolation valves, such as formation isolation valves, for example.

A formation isolation valve may be used in a well for such purposes as preventing fluid loss and controlling an underbalanced condition. The valve forms a controllable sealed access to formations below the valve. When the valve is open, well equipment (a tubular string, a wireline system, a slickline system, etc.) may be deployed through the valve for purposes of performing one or more testing, perforating and/or completion functions below the valve. After these functions are complete, the well equipment may be retrieved, and the valve may be subsequently closed.

For purposes of opening and closing the valve, an intervention may be performed. In the intervention, a tool, such as a shifting tool, is run downhole into the well to engage and change the state of the valve. After the formation isolation valve is closed, the well may be suspended for days or months.

A well intervention typically consumes a significant amount of time and money. Therefore, interventionless techniques have been developed to operate the formation isolation valve. For example, a conventional formation isolation valve may include a chamber that has precharged nitrogen, which acts as a gas spring for purposes of providing downhole power to operate the valve. More specifically, a control mechanism (a J-slot-based mechanism, for example) of the valve, which limits expansion of the nitrogen is remotely controlled from the surface by manipulating the well pressure. After a given sequence of well pressure fluctuations, the control mechanism allows the nitrogen to expand to push a piston for purposes of rotating a ball valve element of the valve open.

A potential challenge in using the above-described formation isolation valve with precharged nitrogen is that the gas chamber of the valve typically is charged on the rig floor next to rig personnel before the valve is run downhole and installed. In addition, under certain well conditions, the well pressure may exceed the rating of the tools in the well or the rating of the ball valve element during the sequence of pressure fluctuations.

Thus, there exists a continuing need for better ways to remotely actuate a downhole tool, such as a formation isolation valve, for example.

SUMMARY

In an embodiment of the invention, a tool that is usable with a well may include an operator, a switch, a spring and an indexer. The switch selectively communicates a first force to the operator to actuate the tool. The spring may be configured to exert a second force, and the indexer may cycle through a sequence of positions in response to the second force and a third force. The sequence of positions may include one or more particular positions configured to cause the switch to communicate the first force to the operator in order to actuate the tool.

In another embodiment of the invention, a technique that is usable with a well includes transitioning an indexer of a tool through a sequence of positions in response to a force that is exerted by a spring. The technique includes selectively communicating a force from a source other than the spring to an operator of the tool in response to the indexer transitioning to a predetermined position.

In another embodiment of the invention, a formation isolation valve that is usable with a well includes a formation isolation valve element, an operator and a seat. The operator actuates the valve element, and the seat is located in a central passageway of the formation isolation valve and is adapted to receive a flowable object to allow pressure in the central passageway above the object to increase to operate the operator to actuate the valve element.

In yet another embodiment of the invention, a technique that is usable with a well includes deploying a flowable object in the well to cause the object to lodge in a seat of a formation isolation valve that is disposed in the well. The technique includes exerting fluid pressure on the object to generate a force to actuate the formation isolation valve.

Advantages and other features of the invention will become apparent from the following drawing, description and claims.

DETAILED DESCRIPTION

In the following description, numerous details are set forth to provide an understanding of the present invention. However, it will be understood by those skilled in the art that the present invention may be practiced without these details and that numerous variations or modifications from the described embodiments are possible.

As used here, the terms "above" and "below"; "up" and "down"; "upper" and "lower"; "upwardly" and "downwardly"; and other like terms indicating relative positions above or below a given point or element are used in this description to more clearly describe some embodiments of the invention. However, when applied to equipment and methods for use in wells that are deviated or horizontal, such terms may refer to a left to right, right to left, or diagonal relationship as appropriate.

Figure 1:
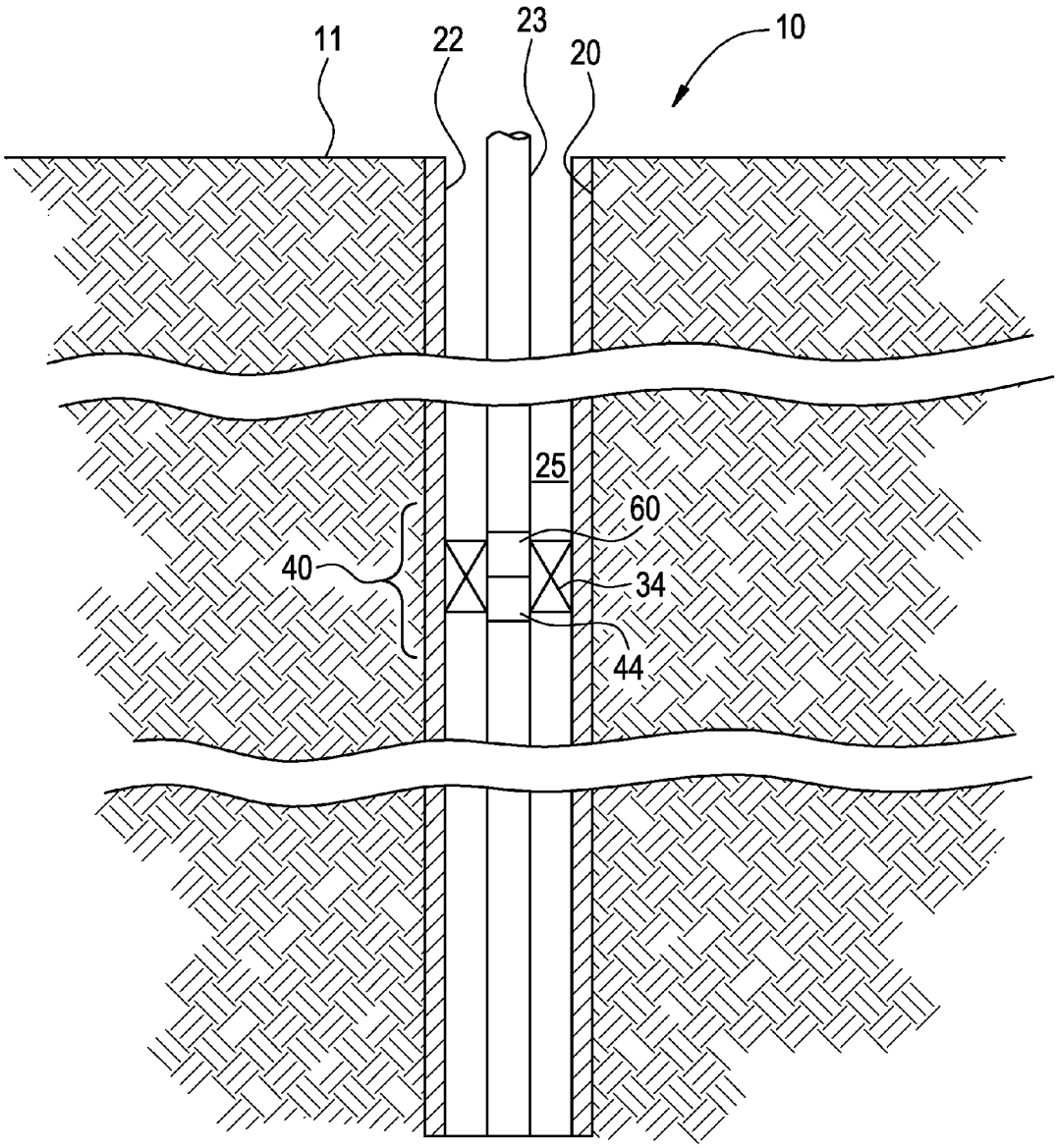
FIG. 1 is a schematic diagram of a well according to an embodiment of the invention.

Referring to FIG. 1, an embodiment 40 of a formation isolation valve in accordance with the invention controls access to a region of a well 10 (a subsea well or a subterranean well) below the valve 40. In this regard, the valve 40 is located downhole in a wellbore 20 and permits well equipment, such as a tubular string (as a non-limiting example), to pass through the valve 40 to the region beneath the valve 40 when the valve 40 is in an open state. Conversely, when the valve 40 is in a closed state, the valve 40 seals off fluid communication with the region beneath the valve 40.

In accordance with embodiments of the invention, the valve 40 may be part of a string 23 that extends downhole through a wellbore 20. The wellbore 20 may or may not be cased (via a casing string 22 for example), depending on the particular embodiment of the invention. Furthermore, although the valve 40 is depicted as being in the vertical wellbore 20, the valve 40 may be disposed in a lateral or deviated wellbore, in accordance with other embodiments of the invention. An annular region, or annulus 25, which is located between an exterior surface of the valve 40 and the interior surface of the casing string 22 (assuming the wellbore 20 is cased) may be sealed off by an annular seal or packer 34.

In general, the valve 40 includes a valve actuator 60 and a valve element 44 that forms a controllable barrier for the valve 40. As examples, the valve element 44 may be a ball-type valve control element or a flapper-type valve control element. Other types of valve control elements are contemplated and are considered within the scope of the appended claims.

The actuator 60 operates the valve element 44 for purposes of controlling the state (open or closed) of the valve element 44 (thus, controlling the state of the valve 40). In accordance with embodiments of the invention described herein, the valve 40 is remotely operable from the Earth surface 11 of the well for purposes of avoiding an intervention to operate the valve. In this regard, in accordance with embodiments of the invention described herein, the actuator 60 of the valve may be remotely operated by manipulating the pressure (herein called the "tubing pressure") inside the string 23. More specifically, in accordance with embodiments of the invention described herein, the tubing pressure may be cycled up and down (via a surface pump (not shown), for example) for purposes of advancing an indexer of the actuator 60. After a predetermined number of up and down pressure variations, the actuator 60 transitions the valve 40 to a predetermined state (e.g., transitions the valve from a closed state to an open state, for example).

As described below, unlike conventional remotely-operable formation isolation valves, the valve 40 does not contain a chamber that has a highly pressurized gas, such as nitrogen. Instead, the valve 40 may rely on downhole well pressure, for example, the pressure exerted by fluid in the tubing string 23 or the pressure that is exerted by fluid in the annulus 25, for purposes of providing a force able to drive the actuator 60 to transition the valve 40 to a predetermined state. Therefore, instead of using a highly pressurized chamber to drive an indexer, the valve 40 may include a relatively weaker mechanism, such as a resilient member including but not limited to a mechanical coiled spring, belleville washers, leaf springs, and other resilient materials, for example, for purposes of cycling the indexer through a predetermined sequence of positions. In general, the indexer is part of a control mechanism to control communication between an operator of the valve 40 and the higher downhole pressure source (the pressure exerted by fluid in the well annulus or tubing string, for example) such that when the indexer reaches its final position, communication between the higher pressure source and the operator is established. This communication may cause the valve 40 to transition to the predetermined state (transition the valve 40 from a closed state to an open state, for example).

Figure 2:
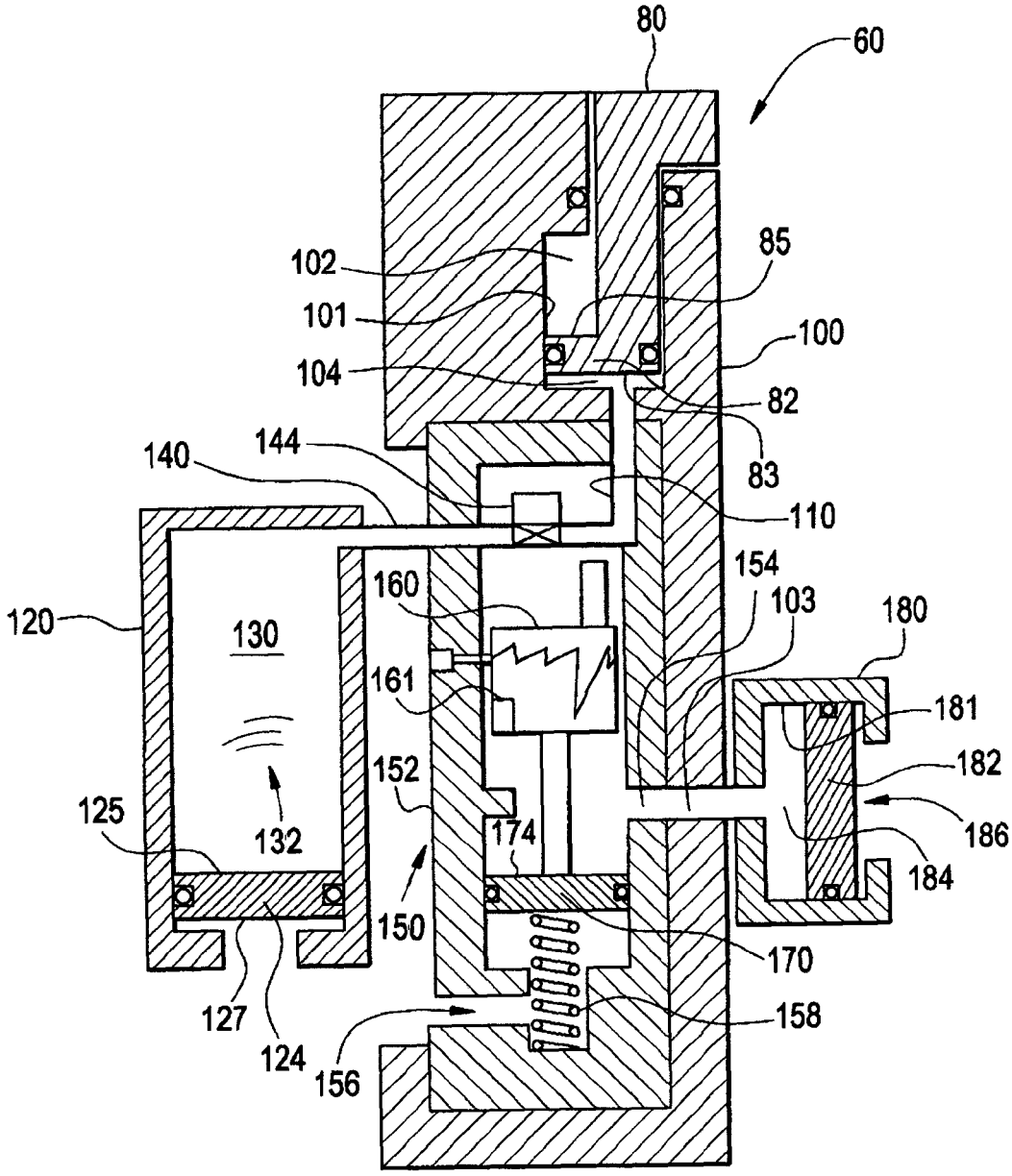
FIG. 2 is a schematic diagram of an actuator of a valve of the well of FIG. 1 according to an embodiment of the invention.

As a more specific example, FIG. 2 depicts a schematic diagram of the actuator 60 in accordance with some embodiments of the invention. In general, the actuator 60 includes a housing 100 that contains an operator, such as an operator mandrel 80. The operator mandrel 80 is constructed to axially translate to open and close the valve element 44 (see FIG. 1) such that near the mandrel's bottom position (depicted in FIG. 2), the valve element 44 is open, and near its upper position, the valve element 44 is closed.

In general, the operator mandrel 80 includes a piston head 82 that resides inside a cavity 101 of the housing 100. The piston head 82 divides the cavity 101 into an upper chamber 102 and a lower chamber 104. Seals that are disposed on the piston head 82 and the housing provide fluid isolation between the chambers 102 and 104. Fluid communication between the lower chamber 104 and a compensator 120, which may apply a well annulus pressure in some embodiments, is selectively established by a switch 144.

The piston head 82 has a piston head surface 83 to receive a force for purposes of driving the operator mandrel 80 upwardly in response to pressure in the lower chamber 104 when the switch 144 is open.

The upward movement of the operator mandrel 80 may be opposed by a downward force produced by fluid pressure (atmospheric pressure, as a non-limiting example) in the upper chamber 102 on an upwardly facing surface 85 of the piston head 82. For example, in accordance with some embodiments of the invention, the force that is generated by the fluid pressure in the chamber 102 on the surface 85 may force the operator mandrel 80 to its bottom position to close the valve 40, in the absence of the pressure-derived force (produced by the compensator 120) when the switch 144 is closed.

For the following example, it is assumed that the valve 40 is closed, and the actuator, or operator mandrel 80, is moved for purposes of opening the valve 40. However, as can be appreciated by one of skill in the art, the valve 40 may likewise be transitioned from an open state to a closed state by a similar mechanism, in accordance with other embodiments of the invention. In addition, in some embodiments other types of tools may be transitioned from a first configuration to a second configuration, due in part to the translation of the operator mandrel 80.

In this illustrative embodiment, when the valve 40 is to remain closed, the piston head 82 is isolated from the well pressure via the switch 144, which is located in a communication path between the compensator 120 and the lower chamber 104. More specifically, as depicted in FIG. 2, the switch 144 may be disposed between a passageway 110 in communication with the lower chamber 104 and a passageway 140 in communication with the compensator 120. The passageways 110 and 140 may be formed in the housing 100.

Depending on the particular embodiment of the invention, the switch 144 serves to selectively isolate the piston head 82 from the well pressure and thus, serves to selectively operate the operator mandrel 80, depending on whether the switch 144 is open or closed. Thus, in some embodiments of the invention, the switch 144 remains closed when the valve 40 is closed, and the switch 144 is opened (as further described below) in order to open the valve 40. In accordance with some embodiments of the invention, the switch 144 may be a type of valve, such as a pilot valve, among others.

The switch 144 is operatively coupled to an indexer 150, which directly or indirectly controls the state (e.g., open or closed) of the switch 144. The indexer 150 includes a housing 152 that houses elements of the indexer 150, such as an indexing mechanism 160 (a J-slot mechanism, among others for example) (the pattern formed on the side of the indexing mechanism in FIG. 2 is for illustrative purposes only and may not be used as a limiting or only example of a functional pathway for an indexing mechanism), a piston head 170 and a mechanical spring 158 (a coiled spring, for example).

In general, the indexing mechanism 160 transitions through a sequence of positions in response to the cycling of the tubing pressure. More specifically, in accordance with some embodiments of the invention, the spring 158 generates an upward force on the piston head 170, which is connected to the indexing mechanism 160. The upward force that is generated by the spring 158 is, however, countered by a downward force that is applied to an upwardly facing surface 174 of the piston head 170. The downward force on the surface 174 may be exerted by well pressure that is in communication with the surface 174 via openings 103 and 154 in the housings 100 and 152, respectively.

In some embodiments, the well pressure may be in direct communication with the surface 174, or as illustrated in FIG. 2, the well pressure may be in indirect communication with the surface 174 via a pressure device 180. Pressure device 180 may include a cavity 181 separated into a first chamber 184 and a second chamber 186 by a piston 182. The second chamber 186 may be in communication with well pressure outside of the pressure device 180, either directly or indirectly (e.g., as through a resilient seal, among others). The first chamber 184 may be filled with clean oil or other type of fluid in order to reduce or prevent the contamination and/or deterioration of the indexing mechanism 160. Pressure variations on one side of piston 182 (i.e., the side of the second chamber 186) may be transmitted to the surface 174 of piston 170 via the non-contaminating fluid. The piston 182 may be sealed in the cavity 181 to prevent or inhibit fluid flow from one camber to the other.

The well pressure (e.g., either tubing or annulus pressure) may be cycled up and downhole to correspondingly move the piston head 170. The movement of the piston head 170 may cycle the indexing mechanism 160 through a predetermined sequence of positions. For example, when the well pressure increases to exert a downward force on the piston head 170 that exceeds the upward force that is exerted by the spring 158, the piston head 170 moves downwardly. When the tubing pressure is relaxed so that the upward force generated by the spring 158 exceeds the downward force that is exerted by the well pressure, the piston head 170 moves upwardly. In accordance with embodiments of the invention, each up and down cycle of the piston head 170 may cause the indexing mechanism 160 to transition to the next position of the sequence.

In some embodiments, the well pressure is determined as a difference between the annulus pressure and the tubing pressure. For example, if the housing 100 has an orifice 156 either directly or indirectly communicating with tubing pressure, then the pressure device 180 may be directly or indirectly communicating with annulus pressure. In such a situation, the piston head 170 may move when the annulus pressure exceeds the tubing pressure plus the force of the spring 158. Of course, the pressure device 180 may be actuated by tubing pressure and orifice 156 may communicate with annulus pressure. Even further, in some embodiments, housing 100 may not comprise orifice 156 and the cavity surrounding spring 158 may contain a compressible fluid (e.g., air or some gas) at atmospheric pressure.

Eventually, the indexing mechanism 160 reaches a position that permits the mechanism 160 to axially shift to a position that actuates switch 144. For example, the indexing mechanism 160 may be connected to a sleeve that has a constrained degree of travel (via a pin and "J-slot" arrangement of the indexing mechanism 160, as a non-limiting example) until the indexing mechanism 160 reaches a position that allows the sleeve to travel beyond its restrained limit to open a port to establish communication between the passageways 140 and 110.

In some embodiments of the invention, further cycling of the tubing pressure may be used to cycle the indexing mechanism 160 back to a position in which the mechanism 160 closes the switch 144. Other switches, switching mechanisms, indexing mechanisms, etc. may be used, in accordance with other embodiments of the invention.

Additionally, some illustrative embodiments may comprise an index locator 161. During shipping of downhole tools, the indexing mechanism 160 may become offset from a position as initially manufactured. Therefore, an index locator 161 may be read at the well site prior to lowering the tool into the well. By using the index locator 161, a well operator may determine the number of pulses or cycles needed to set the indexing mechanism 160 to an actuating position.

The index locator 161 may be any device, component, or method used to determine the position of the indexing mechanism 160 without having to disassemble the tool. Examples of index locators 161 may include, but are not limited to, magnetic materials or fields (e.g., using hall effect sensors for example), radio frequency identification devices (e.g., RFID tags), or dissimilar materials (e.g., a metal or radioactive pin in a non-metallic indexing mechanism 160), among others. By using a reading device external to the housing 100, a technician may be able to determine the location of a magnetic or ferro-magnetic material, thereby indicating the amount of rotation or relative position of the indexing mechanism 160 within the housing 100.

In an exemplary embodiment of the invention, a compensator 120 may be provided to actuate the operator mandrel 80. The compensator 120 may comprise a chamber 130 that contains relatively clean oil 132. A floating piston 124 may be sealably disposed in the chamber 130 and define a movable boundary between the oil 132 and direct or indirect contact with the pressure of the well fluid. A downwardly facing surface 127 of the piston 124 may be in contact with the oil 132, and an upwardly facing surface 125 of the piston 124 may directly or indirectly communicated with the well pressure. Thus, the piston 124 transmits the pressure that is applied by the well fluid in the annulus or tubing to the oil 132. Accordingly, the oil 132 communicates this pressure to the piston head 82 of the operator mandrel 80 when the switch 144 is open.

In accordance with other embodiments of the invention, a downhole tool, such as formation isolation valve, may be operated using a flowable object, such as a ball or a dart. In this regard, the flowable object may be deployed in the well (from the Earth surface 11 (see FIG. 1) of the well, for example) and descend through the well until the object lodges in a seat of the tool. Once lodged in the seat, fluid pressure may be increased above the lodged flowable object to subject the object, and any structure interacting with the object, to a force that operates the tool.

Figure 3:
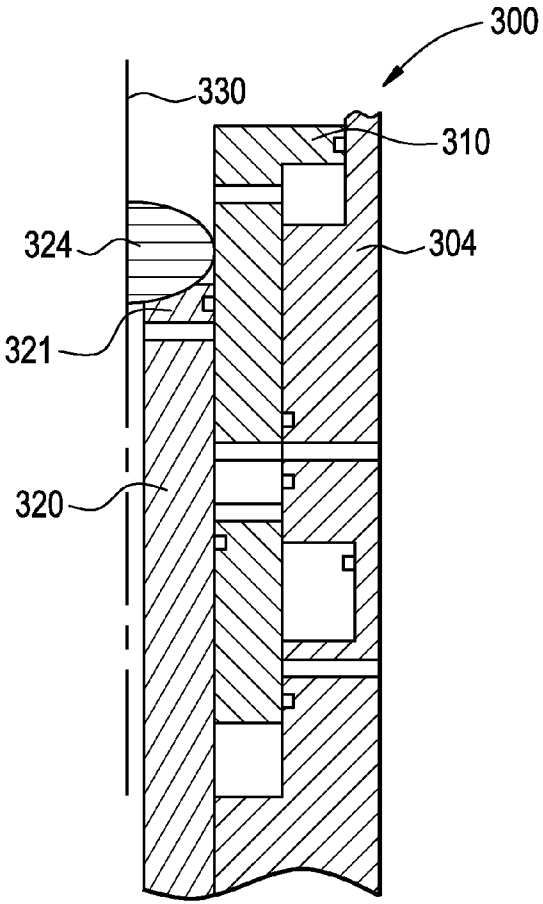

As a more specific example, FIG. 3 depicts a partial schematic diagram of a downhole tool 300 in accordance with an embodiment of the invention. It is noted that FIG. 3 depicts a right hand partial cross-section of the valve about a longitudinal axis 330 of the tool 300. It is understood that the tool 300 includes a mirroring left hand cross-section, as the tool 300 is generally symmetric about the longitudinal axis 330, as can be appreciated by one of skill in the art.

FIG. 3, in general, depicts the tool 300 in an unactuated state. In this regard, the tool 300 includes an operator mandrel 320 that is to be moved in a downward direction to transition the tool 300 to the next desired state. It is noted that the operator mandrel 320 may include, as examples, one or more piston heads for purposes of retaining the mandrel 320 in the position depicted in FIG. 3. Alternatively, releasable mechanical fixtures, such as shear pins, may secure the operator mandrel 320 to a housing 304 of the tool 300, or as yet another example, the operator mandrel 320 may be secured to a mechanical section 310 that may be used to operate the mandrel 320 via an alternative mechanism.

In this regard, in accordance with some embodiments of the invention, the tool 300 may be remotely operated from the surface of the well or may be operated via an intervening tool. It is possible that during the lifetime of the tool 300, the tool 300 does not operate as intended, thereby resulting in the use of a backup control, such as the usage of a flowable object, for example. However, the control scheme that is described in connection with FIGS. 3, 4 and 5 may be a primary control for the tool 300 or a backup control for the tool 300.

Figure 4:
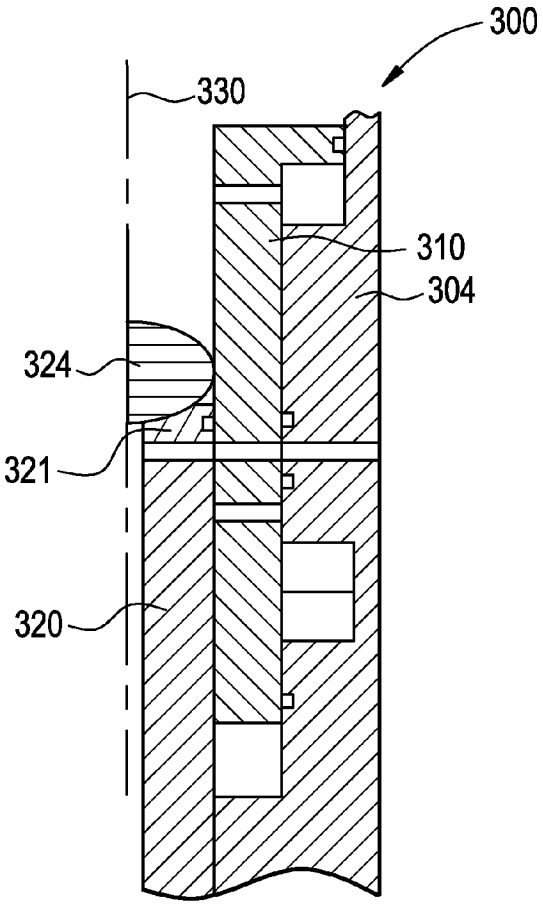
FIGS. 3 and 4 are partial cross-sectional views illustrating operation of a valve according to another embodiment of the invention.

For the example depicted in FIG. 3, the flowable object is a ball 324 that is deployed in the well and lodges in a valve seat 321 that is formed near the top of the operator mandrel 320. When the ball 324 abuts against the seat 321, the ball 324 substantially restricts fluid communication through a central passageway of the tool 300. As a result, fluid may be introduced from the surface of the well for purposes of increasing downward pressure on the ball 324. This increased pressure, in turn, produces a downward force on the ball 324 and correspondingly on the operator mandrel 320. Eventually, the force increases to a point at which the downward force is sufficient to move the operator mandrel 320 in a downward direction and thus, actuate the tool 300. The actuated state of the tool 300 is depicted in FIG. 4.

After the tool 300 is actuated, various techniques may be used to remove the ball 324 from the seat 321 after the tool 300. As examples, an acid or other dissolving fluid may be introduced into the well to dissolve the ball 324; the ball 324 may be frangible and thus, may be fragmented by a direct impact (via a tool) or by acoustic energy (as a non-limiting example); reverse circulation may be used by opening circulation ports in the string above the tool 300 to circulate the ball 324 back to the surface of the well; etc.

Depending on the particular embodiment of the invention, the tool 300 may be an isolation valve (a formation isolation valve, for example). However, the tool 300 may be another type of valve (a sleeve valve, for example) or another type of downhole tool, such as a packer, flow control device, etc. Many variations and types of tools are contemplated and are within the scope of the appended claims.

Figure 5:
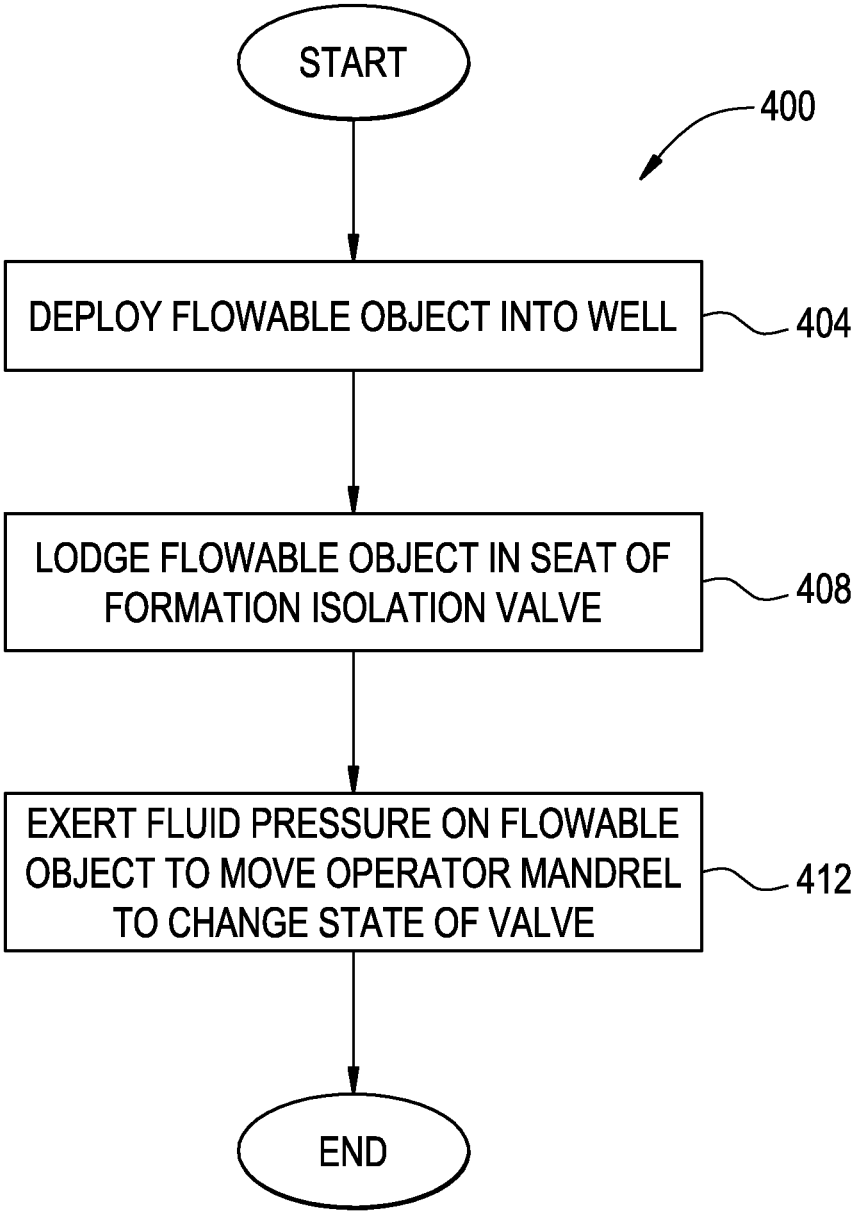
FIG. 5 is a flow diagram depicting a technique to actuate a valve using a flowable object according to an embodiment of the invention.

To summarize, FIG. 5 depicts a technique 400 in accordance with embodiments of the invention. Pursuant to the technique 400, a flowable object is deployed in a well, pursuant to block 404. The flowable object lodges (block 408) in a seat of a formation isolation valve and a pressure is exerted on the ball to move an operator mandrel to change a state of the valve, pursuant to block 412. Other variations are contemplated and are within the scope of the appended claims.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A tool usable in a well, comprising:

an operator having a head disposed within a cavity of a housing of the tool, the cavity being selectively supplied with hydraulic fluid through a passageway;

a switch positioned in the passageway to selectively communicate a first force to the operator to actuate the tool by opening the passageway to flow of the hydraulic fluid;

a compensator coupled to the passageway to supply the hydraulic fluid under pressure via a compensator piston exposed to well pressure in a surrounding annulus; and an indexer operated by a piston head exposed to a force generated by well pressure on one side and to an opposed force generated by a resilient member on the other side, the indexer being able to cycle through a sequence of positions in response to the force and the opposed force, the sequence including a position to cause the switch to open the passageway to flow of the hydraulic fluid to shift the operator.

2. The tool of claim 1, wherein the first force comprises a force produced by fluid in the surrounding annulus disposed within a casing in the well.

3. The tool of claim 1, wherein the first force comprises a force produced by fluid in an annulus of the well.

4. The tool of claim 1, wherein the tool comprises a valve, and the operator comprises a mandrel to operate a valve element of the valve.

5. The tool of claim 4, wherein the valve is a formation isolation valve.

6. The tool of claim 4, wherein a central passageway of the valve further comprises a seat configured to interact with a flowable object so as to facilitate the production of the first force in the central passageway.

7. The tool of claim 1, wherein the resilient member comprises a mechanical spring.

8. The tool of claim 1, further comprising an index locator configured to correlate to a position of the indexer in the sequence of positions.

9. The tool of claim 8, wherein the index locator comprises a magnetic field.

* * * * *